US006677713B1

(12) United States Patent
Sung

(10) Patent No.: US 6,677,713 B1
(45) Date of Patent: Jan. 13, 2004

(54) DRIVING CIRCUIT AND METHOD FOR LIGHT EMITTING DEVICE

(75) Inventor: Chih-Feng Sung, Miaoli (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/065,502

(22) Filed: Oct. 25, 2002

(30) Foreign Application Priority Data

Aug. 28, 2002 (TW) ..... 91119480 A

(51) Int. Cl.[7] ..... G09G 3/10

(52) U.S. Cl. ..... 315/169.1; 315/169.3; 345/204; 345/214; 345/48; 345/78

(58) Field of Search ..... 315/169.1, 169.2, 315/169.3, 204, 214, 82, 42, 55, 92, 99, 44, 46, 78, 48

(56) References Cited

U.S. PATENT DOCUMENTS 6,229,508 B1 * 5/2001 Kane ..... 345/82

6,501,466 B1 * 12/2002 Yamagishi et al. ..... 345/204

* cited by examiner

*Primary Examiner*—Haissa Philogene
(74) *Attorney, Agent, or Firm*—Jiang Chyun IP Office

(57) ABSTRACT

A driving circuit for a light-emitting device, having a driving, a first and a second transistor, and a maintaining capacitor. The light-emitting device is coupled to the driving transistor in series to form a light-emitting path. The on/off state of the driving transistor determines the conductance and on/off state of the light-emitting path. The first transistor has a source region coupled to the gate of the driving transistor and a gate coupled to a first scan line. The second transistor has a source region coupled to a reference low voltage, a drain region coupled to the gate of the driving transistor, and a gate coupled to a second scan line. The pulses of the first and second scan lines have the same frequency, while there is a delay time therebetween. The maintaining capacitor is coupled to the gate of the driving transistor to maintain a voltage state.

19 Claims, 3 Drawing Sheets

DRIVING CIRCUIT AND METHOD FOR LIGHT EMITTING DEVICE

CROSS REFERENCE TO RELATED APPLICATION

This application claims the priority benefit of Taiwan application serial no. 91119480, filed Aug. 28, 2002.

BACKGROUND OF INVENTION

1. Field of the Invention

The invention relates in general to a light-emitting device display technique, and more particular, to a driving technique of an active matrix organic light-emitting diode (AMOLED) to increase the stability of threshold voltage as a function of time.

2. Related Art of the Invention

Following technical advancement, video products, and particularly digital video or image apparatus, have become products commonly seen in our daily lives. Among digital video or image apparatus, the display is a very important device for displaying relative information. The user can read information from the display, or further control operation of the apparatus.

To comply with modern life style, the video or image apparatus has been integrated with lighter weight and smaller volume. The conventional cathode ray tube, though good from a certain aspect, has been replaced by the flat panel display due to the concerns of volume occupancy and power consumption. The currently available flat panel display in the market includes the liquid crystal display and active matrix organic light emitting diode, for example.

The technique of liquid crystal display has been developed for years without a significant breakthrough. The active matrix organic light-emitting technique is a new technique and likely to become the main stream of display. The characteristics of the active matrix organic light emitting diode include using thin-film transistor (TFT) technique to drive the light-emitting diode, and forming the driving integrated circuit (IC) on the panel directly. Therefore, the requirements of being thin, light, short and small, and low cost are met. The active matrix organic light-emitting diode is suitable for use in cellular phones, personal data assistants, digital cameras, palm pilots, portable DVD players, and the vehicle navigation system. The future application of the active matrix organic light-emitting diode includes large-scale flat panels such as for computers and flat panel televisions.

For digital displays, the display screen is formed of a plurality of pixels arranged as an array. To control individual pixels, a scan line and a data line are used to apply operation voltage to the selected pixels, such that the data of the selected pixels are displayed. FIG. 1 shows a schematic circuit diagram of a conventional driving circuit of an active matrix organic light-emitting diode. The driving circuit includes a transistor 100 and a transistor 102. The transistors 101 and 102 are thin-film. transistors (TFT). The gate of the transistor 100 is coupled to a scan line to receive a scan voltage Vscan at an appropriate pulse, and the source region thereof is to receive a data voltage Vdata from a data line at this pulse. The drain region of the transistor 100 is coupled to the gate of the transistor 102. Normally, the source region and drain region of the transistors 100 and 102 are interchangeable. A storage capacitor 106 is connected between the gate of the transistor 102 and a ground voltage. The drain region of the transistor 102 is coupled to a source voltage $V_{DD}$. The source region of the transistor 102 is coupled to an anode of an active matrix organic light-emitting diode 104 in series. The active matrix organic light-emitting diode 104 further has a cathode coupled to a relative low voltage $V_{SS}$.

The operation of the driving circuit as shown in FIG. 1 is described as follows. When the gate of the transistor 100 is conducted by receiving the scan voltage Vscan from the scan line, the data voltage Vdata is input to the gate of the transistor 102 to conduct via the transistor 100. Thereby, the transistor 102 is also conducted. The source voltage $V_{DD}$ is then applied to the organic light-emitting device 104 to emit a light. The transistor 102 is typically referred as a driving device. During circuit operation, the voltage Vscan will be input to the transistor 100 with a predetermined frequency via the scan line. The time period between two consecutive pulses is referred as a frame, and a predetermined image data block will be input to the corresponding pixel within a frame. When the transistor 100 is activated by a clock pulse of the scan voltage Vscan, the transistor 102 is activated by the data line Vdata. The data voltage Vdata is stored in the storage capacitor 106 to maintain the activation of the transistor 102.

Therefore, the organic light-emitting device 104 is switched on in any frame. It is only that different gray scale display results according to the data voltage in different frames. In other words, in the traditional design, the light-emitting device of TFT active matrix organic light-emitting diode is continuously illuminating. This luminescent method meets the image display effect and prevents the screen from flashing. However, as the light-emitting device is continuously driven, the transistor 102 is maintained at an on state all the time. For a normal transistor 102, particular the thin-film transistor 102, the long operation time will cause change of the characteristics. For example, the threshold voltage is increased with operation time. As shown in FIG. 2, this affects the luminescent status of the light-emitting device. For example, the luminance or chroma is changed. The effect caused by the shift of the threshold voltage can be expressed by the following relationship.

When the light-emitting device 104 is activated, the driving current$_D$ can be presented by equations (1) and (2) as:

$$I_D = \frac{1}{2}k(V_{gs} - V_{th})^2 \tag{1}$$

$$I_D = \frac{1}{2}k(V_G - V_S - V_{th})^2 \tag{2}$$

In the above equations, k is a characteristic constant of thin-film transistor. From equations (1) and (2), if the threshold voltage is increased with time, the driving current/$_D$ flowing through the organic light-emitting device 104 is decreased, and consequently, the luminance is decreased. The lifetime is also determined by the luminance. Therefore, the variation of threshold voltage $V_{th}$ is crucial to the organic light-emitting device 104.

SUMMARY OF INVENTION

The present invention provides a driving circuit for a light-emitting device. The driving circuit can maintain the threshold voltage of a driving transistor at a stable value after long operation time of image display. Therefore, the product display quality is enhanced.

The present invention further provides a driving circuit for a light-emitting device that receives a normal scan line signal and an additional scan line signal with a delay to the normal scan line signal. When the driving circuit of the light-emitting device is activated by the additional scan line signal, the normal image data voltage is replaced by a discharge low voltage. Thereby, the driving transistor is switched off, and the threshold voltage $V_{th}$ is reset to the initial value.

The driving circuit of the light-emitting device provided by the present invention is suitable for using in an active matrix organic light-emitting diode. The driving circuit comprises a driving transistor, of which a gate is coupled to a node. The light-emitting device is coupled to the driving transistor in series to form a light-emitting path. The light-emitting path is connected between a system high voltage and a system low voltage. When the driving transistor is switched on, the light-emitting device is driven by the system high voltage to be illuminated. The driving circuit also comprises a maintaining capacitor coupled to the node to maintain the on state of the driving transistor. The driving circuit further comprises a system driving path which includes a first transistor and a second transistor connected to the node in series. The first transistor has a gate to receive a first scan clock pulse and the second transistor has a gate to receive a second scan clock pulse. The first clock pulse and the second clock pulse have the same frequency. The second scan clock pulse is delayed from the first scan clock pulse by a delay time.

When the first transistor is activated by a plurality of continuous pulses of the first scan clock pulse, a data voltage corresponding to a frame is input to the node to control the activation of the driving transistor, so as to perform an image display. When the second transistor is activated by a plurality of continuous pulses of the second scan clock pulse, a switch-off voltage is input to the node to switch off the driving transistor.

The switch-off voltage as mentioned above is a negative voltage allowing the driving transistor to be switched off, and the capacitor to discharge to a lower voltage level.

The present invention further provides a driving circuit of a light-emitting device. The driving circuit includes a driving transistor. The light-emitting device is coupled to the driving transistor to form a light-emitting path. The on/off state of the driving transistor determines the on/off state of the light-emitting path. The driving circuit further includes a first transistor, a second transistor and a maintaining capacitor. The first transistor has a source region coupled to a data line, a drain region coupled to the gate of the driving transistor, and a gate coupled to a first scan line. The second transistor has a source region coupled to a reference low voltage, a drain region coupled to the gate of the driving transistor, and a gate coupled to a second scan line. The clock pulses of the first and second scan lines have the same frequency. The clock pulse of the second scan line is delayed from that of the first scan line by a delay time. The maintaining capacitor is coupled to the gate of the driving transistor to maintain a voltage state.

The reference low voltage is a negative voltage switching off the driving transistor and discharging the maintaining capacitor to a low voltage level.

The present invention further provides a driving method for a light-emitting device using a driving circuit that comprises a light-emitting unit and a control transistor. The control transistor is controlled by a scan line and a data line to output a control signal to an input terminal of the light-emitting unit. The method includes providing a reset device to output a voltage signal via a clock pulse. The clock pulse of the reset device has the same frequency of a clock pulse of the scan line, however, is delayed therefrom by a delay time. According to the clock pulse of the reset device, the voltage signal is output to the input terminal of the light-emitting device to temporarily stop the light-emitting device from illuminating.

BRIEF DESCRIPTION OF DRAWINGS

These, as well as other features of the present invention, will become more apparent upon reference to the drawings wherein.

DETAILED DESCRIPTION

The present invention is characterized in using a first scan signal and a second scan signal to control a driving circuit of a light-emitting device. The first scan signal activates the driving circuit to drive the light-emitting device receiving the image data signal and displaying the image. When the driving circuit is activated by the second scan signal, a discharge or reset voltage signal replaces the image data signal to reset the driving circuit, such that the threshold voltage returns to the initial value. Therefore, the threshold voltage is maintained at a stable value as the operation continues.

The characteristics of human vision are taken into account in the present invention. Without affecting visual effect, the threshold voltage can be switched off by switching off the driving circuit of the light-emitting device in a transient, such that the threshold voltage tends to be stabilized without being shifted due to long activation time.

The persistence of vision prevents the human eye from discriminating an image flashing rate over 60 Hz. That is, when an AC frequency of a normal light is 60 Hz, the flashing effect of the light cannot be discriminated by human eyes. When a frame is displaying images, if the transient variation is faster than the change of the frames, the human eye cannot feel the flashing caused by the dark picture generated by switching off the light-emitting device though the total brightness is decreased. As the brightness can be adjusted and compensated for, the problem relate d to brightness is thus relatively easy to resolve.

Figure 2:
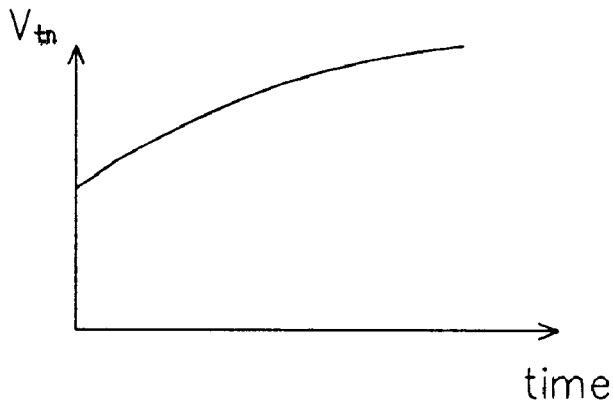
FIG. 2 (PRIOR ART)
FIG. 2 shows a schematic drawing of threshold voltage variation of the conventional driving transistor as a function of activation time.
Figure 3:
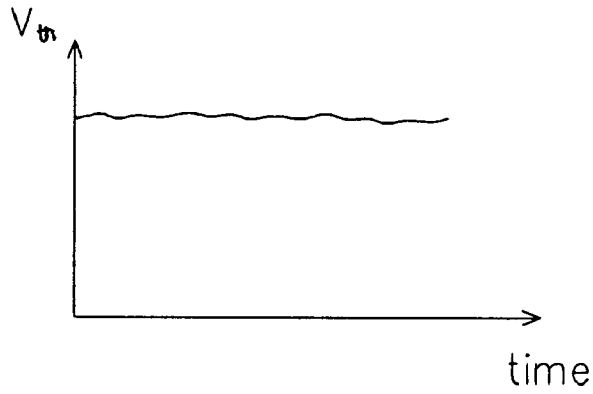
FIG. 3 shows a schematic drawing of threshold voltage variation of the driving transistor as a function of activation time according to the present invention.

FIG. 3 shows the variation of threshold voltage of a driving circuit as a function of activation time. Compared to the operation of the conventional driving circuit as shown in FIG. 2 where the threshold voltage is increased with operation time, a stable threshold voltage is obtained in the present invention. To obtain such stable threshold voltage, the present invention provides a design of the driving circuit as shown in FIG. 4.

Figure 1:
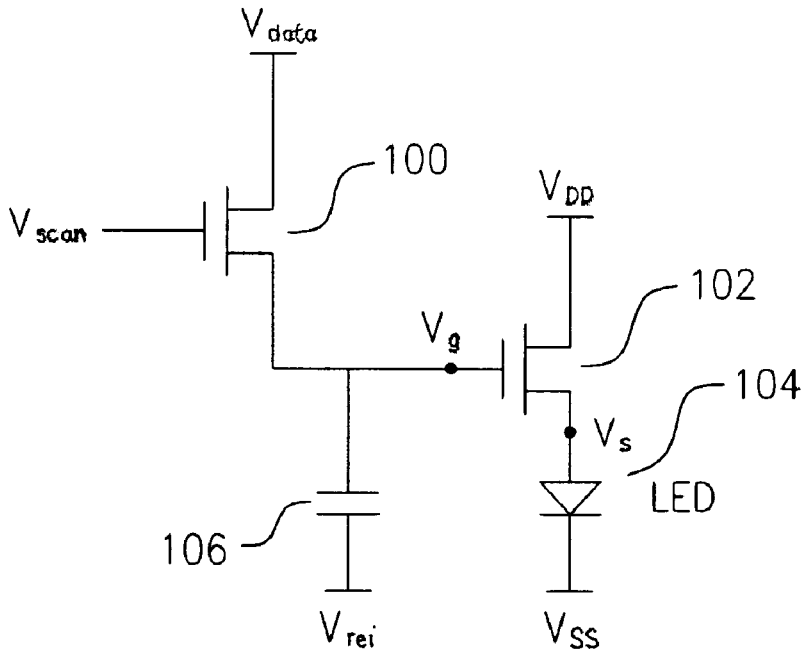
FIG. 1 (PRIOR ART)
FIG. 1 shows a circuit diagram for driving a pixel of an organic light-emitting diode.
Figure 4:
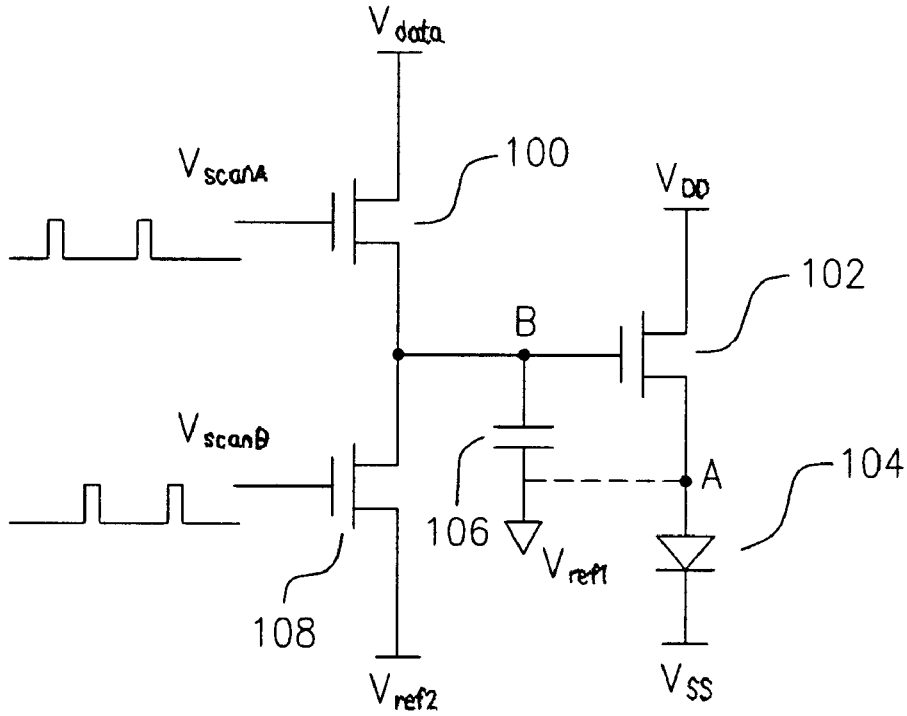
FIG. 4 shows a circuit diagram for driving a pixel of a light-emitting device according to the present invention.

In FIG. 4, the circuit diagram for driving the pixel of the light-emitting device is shown. The transistors 100, 102, the light-emitting device 104, and the maintaining capacitor 106 are similar to those as shown in FIG. 1. The transistors 100 and 102 include P-type or N-type thin-film transistors, for example. The bottom electrode of the maintaining capacitor 106 can be coupled to either the ground or to the node A. The node A is the drain region of the transistor 102. The light-emitting device 104 includes an organic light-emitting diode. The maintain capacitor 106 is used to maintain the on/off state of the transistor 102. For example, when the transistor 102 is switched on by the high level pulse of the scan line VscanA, the maintain capacitor 106 is charged simultaneously. When the scan line VscanA is decreased to a low voltage level, the maintaining capacitor 106 maintains the on state of the transistor 102, such that the light-emitting device 104 continues illuminating.

The transistor 102 is coupled to the light-emitting device 104 in series to form a light-emitting path. The serial connection sequence between the transistor 102 and the light-emitting device 104 is adjusted according to specific design without affecting the driving mechanism. Under the typical driving principal, the transistor 102, the light-emitting device 104 and the maintaining capacitor 106 can be treated as a light-emitting unit of the driving circuit.

In addition to the light-emitting unit, the driving circuit provided by the present invention further includes a different design. For example, the transistor 100 is included and controlled by the scan line VscanA and the data line Vdata to display the picture or image. The operation theory is the same as the conventional driving circuit and is not introduced again.

In the present invention, a node B is further coupled to a transistor 108. More specifically, the drain region of the transistor 108 is coupled to the node B to symmetrically correspond to the data line Vdata. The gate of the transistor 108 is coupled to another scan line VscanB, and the source region thereof is coupled to a relatively low voltage Vref2 such as a negative voltage. In terms of functionality, the relatively low voltage Vref2 includes a discharge voltage, a switch-off voltage, or a reset voltage. The function is further described as follows.

Figure 5:
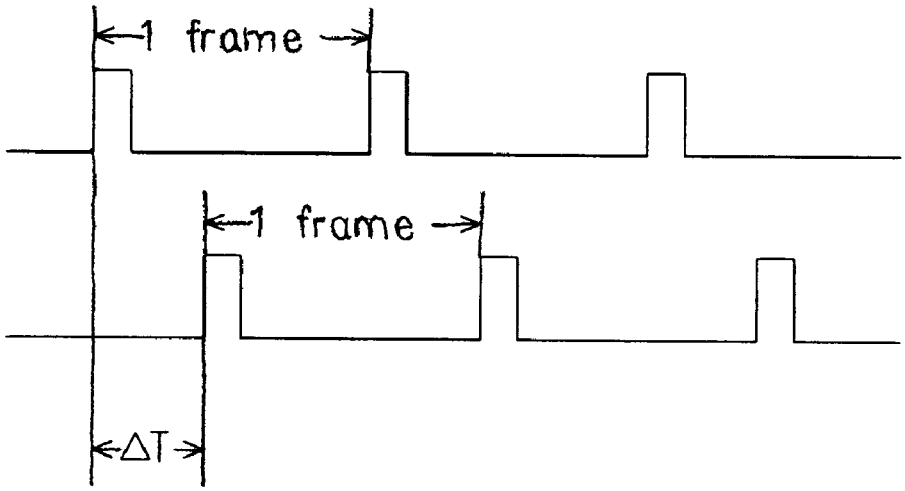
FIG. 5 shows the sequence relation of two scan lines corresponding to the circuit as shown in FIG. 4.

In the above embodiment, the scan lines VscanA and VscanB have the same frequency, while the scan line VscanB delays the scan line VscanA by a delay time dT. As shown in FIG. 5, the delay time dT can be any fraction of one frame. To simplify the actual operation control, the delay time dT is set up as T/n, where T is the time period of a frame, and n is a positive integer larger than one. Therefore, the delay time is T/2, T/3, T/4, . . . , etc.

When the transistor 100 is activated by the clock pulse of the scan line VscanA, the transistor 108 is in an off state in correspondence with the scan line VscanB. Therefore, the relatively low voltage Vref2 does not affect the control of the data line Vdata. The corresponding pixels of the light-emitting device can thus be illuminated with predetermined luminance and chroma by the voltage of the data line.

When the clock pulse of the scan line VscanA passes, the transistor 108 is activated at the delay time by the pulse of the scan line VscanB. Meanwhile, the data line Vdata is not affected as the transistor 100 is switched off. However, as the transistor 108 is switched on, the relatively low voltage Vref2 is input to the transistor 102 and the maintaining capacitor 106 via the node B. As the voltage Vref2 is a low voltage, preferably a negative voltage, the transistor 102 is switched off, and the maintaining capacitor 106 is discharged to the voltage Vref2. Meanwhile, as the transistor 102 is switched off, the threshold voltage Vth thereof is reset to an initial value thereof instead of being increased as shown in FIG. 2. The transistor 102 is switched off until reaching the second frame, where the next pulse of the scan line VscanA is activated and input.

When the transistor 102 is switched off, the consequent effect is that the light-emitting device 104 is switched off to result in a completely dark frame. As mentioned above, the frequency of the dark picture is the same as that of the frames, for example, 60 Hz, so that the human eye cannot notice the flashing picture. The only effect sensitive to human eyes is the reduced brightness, which can be easily compensated for and is minor compared to the effect caused by threshold voltage variation. Further, the delay time can be increased to reduce the completely dark period, while the transistor 102 can be reset. The brightness can thus be compensated and adjusted to resolve the related problem.

According to the above, the present invention comprises a transistor 108 accompanied with the scan line VscanB. The transistor 108 is treated as a reset device controlled by a clock pulse to transiently switch off the driving circuit.

Accordingly, the present invention includes the following advantages:

1. The present invention uses a first scan signal and a second scan signal to control a driving circuit of a light-emitting device, such that the driving circuit is normally activated by the first scan signal to receive the image data signal, so as to display the image. When the driving circuit is activated by the second scan signal, a voltage discharge or voltage signal replaces the image data signal allowing the driving circuit to reset. Thereby, the threshold voltage returns to the initial value. That is, the threshold voltage is maintained at a stable value as the operation continues.

2. Th e present invention provides a driving circuit for a light-emitting device, in which the threshold voltage of a driving transistor is maintained at a stable value, so that the display quality is enhanced.

3. The present invention provides a driving method for a light-emitting device. In addition to a normal scan signal, an additional scan signal is generated. The additional scan signal is delayed from the normal scan signal by a delay time. When the driving circuit of the light-emitting device is activated by the additional scan signal, the normal image data is replaced by a discharge low voltage to switch off the transistor, such that the threshold voltage Vth is reset to an initial value.

Other embodiments of the invention will appear to those skilled in the art from consideration of the specification and practice of the invention disclosed herein. It is intended that the specification and examples be considered as exemplary only, with a true scope and spirit of the invention being indicated by the following claims.

What is claimed is:

1. A driving circuit for a light-emitting device, suitable for using in an active matrix organic light-emitting diode, the driving circuit comprising:

a driving transistor, having a gate coupled to a node;

a light-emitting device, coupled to the driving transistor in series to form a light-emitting path, wherein the light-emitting path is connected between a system high voltage and a system low voltage, and when the driving transistor is activated, the light-emitting device is driven by the system high voltage to illuminate;

a maintaining capacitor, coupled to the node to maintain an on/off state of the driving transistor; and a system driving path, including a first transistor and a second transistor connected to each other in series through the node, wherein the first transistor has a gate receiving a first scan clock pulse, and the second transistor has a gate receiving a second scan clock pulse, the first and second scan clock pulse have the same frequency, while the second scan clock pulse is delayed from the first scan clock pulse by a delay time;

wherein when the first transistor is activated by a plurality of pulses of the first scan clock pulse, a data voltage corresponding to one frame is input to the node for controlling activation of the driving transistor to perform image display; and when the second transistor is activated by a plurality of pulses of the second clock pulse, a switch-off voltage is input to the node to switch off the driving transistor.

2. The driving circuit according to claim 1, wherein the light-emitting device includes an active matrix organic light-emitting device.

3. The driving circuit according to claim 1, wherein the delay time is T/n, wherein T is a period of the first scan clock pulse, and n is a positive integer larger than 1.

4. The driving circuit according to claim 1, wherein the driving transistor includes an N-type thin-film transistor or a P-type thin-film transistor.

5. The driving circuit according to claim 1, wherein the first and second transistors include N-type thin-film transistors or P-type thin-film transistors.

6. The driving circuit according to claim 1, wherein the switch-off voltage includes a positive voltage lower than the data voltage.

7. The driving circuit according to claim 1, wherein the switch-off voltage includes a negative voltage.

8. A driving circuit for a light-emitting device, comprising:

a driving transistor, including a gate;

a light-emitting device, coupled to the driving transistor in series to form a light-emitting path, wherein an on/off state of the driving transistor determines an on/off state of the light-emitting path;

a first transistor, having a source region coupled to a data line, a drain region coupled to the gate of the driving transistor, and a gate coupled to a first scan line;

a second transistor, having a source region coupled to a reference low voltage, a drain region coupled to the gate of the driving transistor, and a gate coupled to a second scan line, wherein clock pulses of the first and second scan lines have the same frequency, and the second scan line delays from the first scan line by a delay time; and a maintaining capacitor, coupled to the gate of the driving transistor to maintain a voltage state thereof.

9. The driving circuit according to claim 8, wherein the light-emitting device includes an active matrix organic light-emitting diode.

10. The driving circuit according to claim 8, wherein the delay time is T/n, wherein T is a period of the first scan clock pulse, and n is a positive integer larger than 1.

11. The driving circuit according to claim 8, wherein the driving transistor includes an N-type thin-film transistor or a P-type thin-film transistor.

12. The driving circuit according to claim 8, wherein the first and second transistors include N-type thin-film transistors or P-type thin-film transistors.

13. The driving circuit according to claim 8, wherein the reference low voltage includes a positive voltage able to switch off the driving transistor.

14. The driving circuit according to claim 8, wherein the reference low voltage includes a negative voltage able to switch off the driving transistor.

15. A driving method of a driving circuit for driving a light-emitting device which comprises a light-emitting unit and a control transistor, wherein the control transistor is controlled by a scan line and a data line to output a control signal to an input terminal of the light-emitting unit, the method comprising:

providing a reset device operative to output a voltage signal by a clock;

setting the clock of the reset device, such that a clock of the scan line and the clock of the reset device have the same frequency, while the clock of the reset device is delayed by a delay time; and outputting the voltage signal to the input terminal of the light-emitting unit, according to the clock of the reset device, such that the light-emitting unit temporarily stops illuminating.

16. The method according to claim 15, wherein the voltage signal includes a discharge voltage.

17. The method according to claim 15, wherein the voltage signal temporarily switches off a driving transistor in the light-emitting unit for controlling a light-emitting device.

18. The method according to claim 15, wherein when the clock of the scan line activates the control transistor, an image data of the data line is input to the light-emitting unit for displaying an image of the image data.

19. The method according to claim 15, wherein the light-emitting unit is reset when the voltage signal is input to the light-emitting unit.

* * * * *